United States Patent [19]

Kedzierski

[11] 4,074,399

[45] Feb. 21, 1978

[54] SLIDER FOR SLIDE FASTENER

[75] Inventor: Stanley G. Kedzierski, Saegertown, Pa.

[73] Assignee: Textron, Inc., Providence, R.I.

[21] Appl. No.: 740,006

[22] Filed: Nov. 8, 1976

[51] Int. Cl.[2] ..... A44B 19/30

[52] U.S. Cl. ..... 24/205.14 R

[58] Field of Search ..... 24/205.14 R

[56] References Cited

U.S. PATENT DOCUMENTS

| | | | |
|---|---|---|---|
| 2,657,445 | 11/1953 | Weber | 24/205.14 R |
| 2,913,795 | 11/1959 | Brown | 24/205.14 R |
| 3,010,170 | 11/1961 | Voity | 24/205.14 R |
| 3,045,307 | 7/1962 | Poux | 24/205.14 R |
| 3,320,645 | 5/1967 | Burbank | 24/205.14 R |
| 3,427,692 | 2/1969 | Rowlands | 24/205.14 R |
| 3,956,800 | 5/1976 | Kawashima | 24/205.14 R |

FOREIGN PATENT DOCUMENTS

| | | | |
|---|---|---|---|
| 1,405,696 | 9/1975 | United Kingdom | 24/205.14 R |

*Primary Examiner*—Bernard A. Gelak
*Attorney, Agent, or Firm*—O'Brien & Marks

[57] ABSTRACT

A slider for a slide fastener is disclosed which includes a slider body, a locking spring and a pull tab. The locking spring includes a locking prong extending through the slider body to engage the coupling elements of the slide fastener to lock the slider. Pulling on the pull tab in either direction cams the cross bar of the pull tab upward to release the lock and allow movement of the slider.

6 Claims, 5 Drawing Figures

FIG. 1
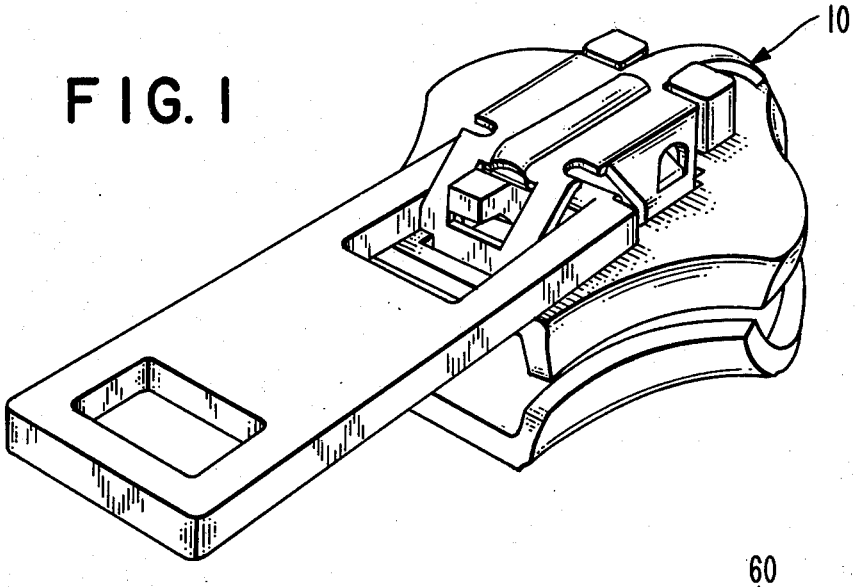
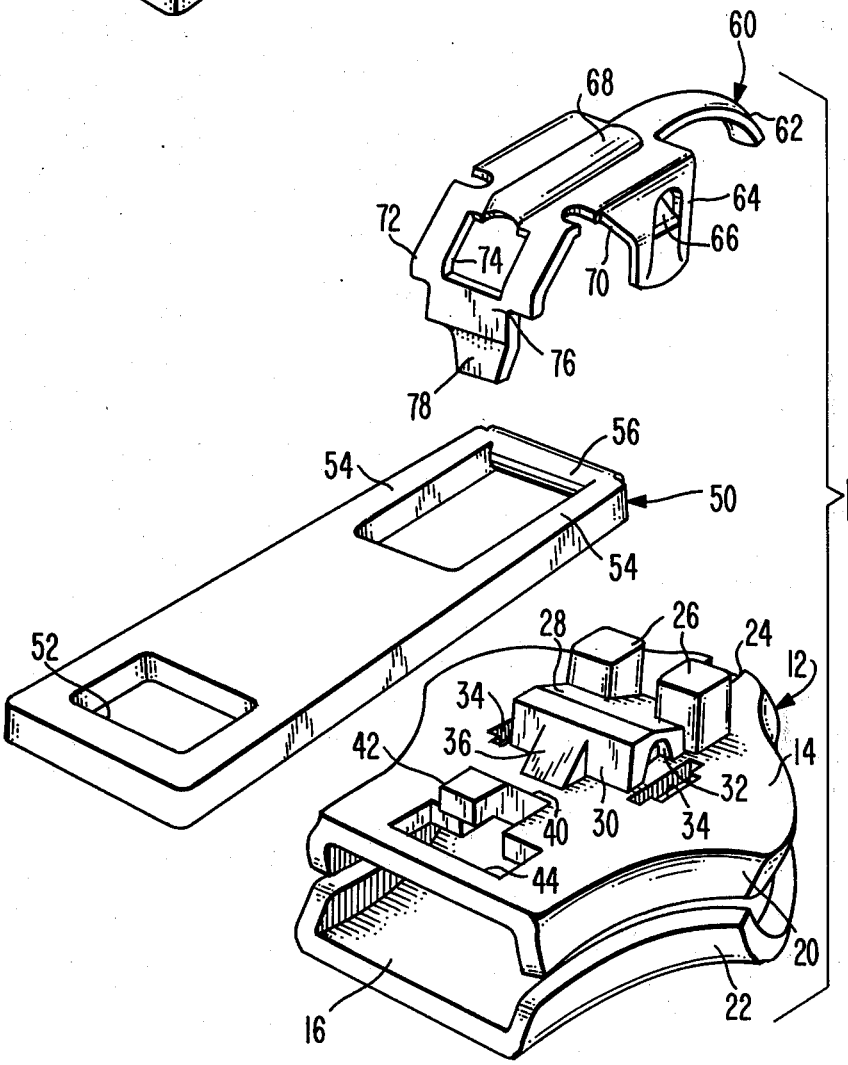
FIG. 2

SLIDER FOR SLIDE FASTENER

BACKGROUND OF THE INVENTION

1. Field of the Invention

The present invention relates to sliders for slide fasteners and in particular to such sliders which have means to automatically lock in place in between the coupling elements of the slide fastener when the pull tab is not being pulled.

2. Description of the Prior Art

The prior art includes a number of types of locking slide fastener sliders. U.S. Pat. Nos. 1,967,137, 2,683,911, 3,046,628, 3,574,247, 3,793,684, 3,798,715, and 3,899,804 illustrate a broad sample of the state-of-the-art for such sliders. U.S. Pat. No. 3,956,800 shows a slider for a slide fastener including leaf spring with a locking pawl which extends through an aperture in the top wing of the slider to engage the coupling elements.

SUMMARY OF THE INVENTION

The present invention is summarized in that a slider for a slide fastener includes a slider body including upper and lower spaced parallel wings joined by a connecting post, a boss formed on the upper wing of the slider body and having retention means formed therein, a forward cam surface formed on the upper wing of the slider body behind the boss, a rear cam surface formed on the upper wing of the slider body behind the forward cam surface, the upper wing having a locking hole extending therethrough behind the rear cam surface, a locking spring having retention means cooperating with the retention means on the boss to secure the locking spring on the slider body, a locking prong depending from the locking spring and extending through the locking hole to prevent movement of the slider along the slide fastener, forward and rear abutment surface means formed on the locking spring above the forward and rear cam surfaces on the slider body, a pull tab having a pair of forwardly extending pull arms and a cross arm extending between the pull arms, the cross bar being received between the locking spring and the slider body between the forward and rear cam surfaces and the forward and rear abutment surface means so that any pulling on the pull tab lifts the locking prong to free the slider for movement.

It is an object of the present invention to construct a slider for a slide fastener that automatically locks to the coupling elements when the pull on the pull tab is released.

It is another object of the present invention to provide such a slider that is simple, reliable and economical to manufacture.

It is yet another object of the present invention to construct such a slider from multiple parts which securely and permanently snap-fit together to form the finished slider.

Other objects, advantages and features of the present invention will become apparent from the following specification when taken in conjunction with the accompanying drawings.

BRIEF DESCRIPTION OF THE DRAWINGS

FIG. 1 is a perspective view of a slider for a slide fastener constructed according to the present invention.

FIG. 2 is an exploded perspective view of the slider of FIG. 1.

DESCRIPTION OF THE PREFERRED EMBODIMENT

Figure 3:
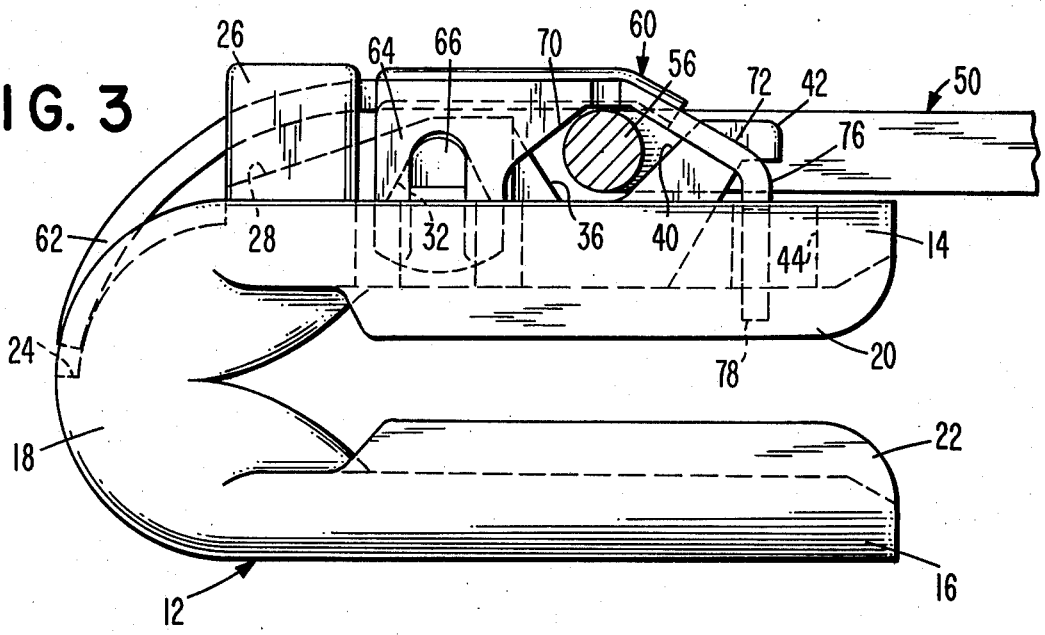
FIG. 3 is a side plan view of the slider of FIG. 1 in a locked position with part of the pull tab cut away.

As is illustrated in FIG. 1, the present invention is embodied in a slider, generally indicated at 10, for use in a slide fastener. The slider 10 includes a slider body, indicated generally at 12 in FIG. 2, that is either coined or die-cast of a metal. The slider body 12 includes upper and lower spaced parallel wings 14 and 16 which are joined at their front ends by a diamond head or connecting post 18. The upper and lower wings 14 and 16 are generally similar in shape and have similar pairs of flanges 20 and 22 formed along their lateral side edges extending toward the other of the wings. Formed in the top surface of the upper wing 14 and extending forward into the connecting post 18 is a spring groove 24. Formed on the upper surface of the upper wing 14 just behind the spring groove 24 are a pair of upstanding rectangular guide lugs 26 which are positioned on opposite sides of the longitudinal center line of the slider body 12 which extends through the spring groove 24. Starting in between the guard lugs 26 and extending toward the rear of the slider body 12 is a ramp-like spring support surface 28 formed on the front face of a boss 30. The boss 30, which extends laterally almost to the outermost edges of the two guard lugs 26, has its front side formed by the support surface 28 and has vertical rear and side surfaces. A retention cavity 32 of a generally arch-like shape is formed in each of the vertical side surfaces of the boss 30. A pair of cut-outs 34 are formed extending through the upper wing 14 of the slider body 12, each cut-out 34 being located just adjacent a one of the retention cavities 32. The cut-outs 34 are each formed of two adjacent longitudinally aligned elongated slots with the longer of the two slots being disposed on the inside toward the longitudinal centerline of the slider body 12. A forward cam surface 36 is formed by a steep ramp-like triangular extension formed on the rear surface of the boss 30. A rear cam surface 40 is formed on the forward face of a spring holding finger 42 which extends upward and rearward from the upper wing 14 of the slider body 12 rearward of the forward cam surface 36. The holding finger 42 extends over a locking hole 44 provided extending through the upper wing 14, the locking hole 44 being a laterally elongated rectangular recess formed in the upper wing 14.

The slider 10 also includes a pull tab, indicated generally at 50, which is a flat slab preferably formed of a suitable thermoplastic material such as nugild. The pull tab 50 has a pull recess 52 formed at its rear end and a pair of forwardly extending pull arms 54 formed on its front end. The front ends of the pull arms 54 are joined by a cross bar 56 extending between them. The cross bar 56 is, in this embodiment, formed so as to have a generally circular cross-section having a diameter approximately equal to the vertical width of the pull arms 54.

The slider 10 also includes a locking spring, indicated generally at 60, formed preferably of a stamped and folded thin sheet of stainless steel. The locking spring 60 has an elongated and downwardly curved forward projection 62 extending from its front end and a pair of downwardly extending retention arms 64 formed midway along its sides. The retention arms 64 each has a retaining tab 66 formed therein which is bent inward midway in its length so that the upper end of each of the retaining tabs 66 is biased inwardly at a canted angle. A longitudinal reinforcing rib 68 is formed in the central portion of the locking spring 60. Sloped forward abutment surfaces 70 are provided on the bottom of the locking spring 60 connecting the back edges of each of the retention arms 64 to the main portion of the locking spring 60 by canted surfaces. A downwardly canted rear abutment surface 72 of the locking spring 60 has a rectangular hole 74 formed in it by a cut-out portion. Extending vertically downward from the rear of the rear abutment surface 72 of the locking spring 60 is a tail portion 76 which terminates in a locking prong 78. The locking prong 78 is slightly offset to one side from the longitudinal center line of the locking spring 60.

In assembling the slider 10 from the slider body 12, the pull tab 50 and the locking spring 60, the pull tab 50 is first placed on the slider body 12 so that the cross bar 56 lies on the top surface of the upper wing 14 of the slider body 12 between the forward and rear cam surfaces 36 and 40. The locking spring 60 is then brought downward over the slider body 12 with the forward projection 60 being received between the guard lugs 26 in the spring groove 24, the retention arms 64 being positioned on either side of the boss 30 so that they are received in the cut-outs 34, and the locking prong 78 being received in the locking hole 44. The locking spring 60 snaps into position secured to the slider body 12 when the retaining tabs 66 snap into place inside of the retention cavities 32 in the boss 30 and the tail portion 76 of the locking spring 60 snaps over the finger 42 which is received in the hole 74 in the rear abutment surface 72. The wider portions of the cut-outs 34 are provided so that the retaining tabs 66 will have room in which to be bent backward during the insertion of the retention arms 64 into the cut-outs 34. However it is also possible within the scope of the present invention to form the retaining tabs 66 initially flat and coplanar with the retention arms 64, the retaining tabs 66 being bent to their final positions inside the retention cavities 32 only after the retention arms 64 are received in the cut-outs 34.

Figure 4:
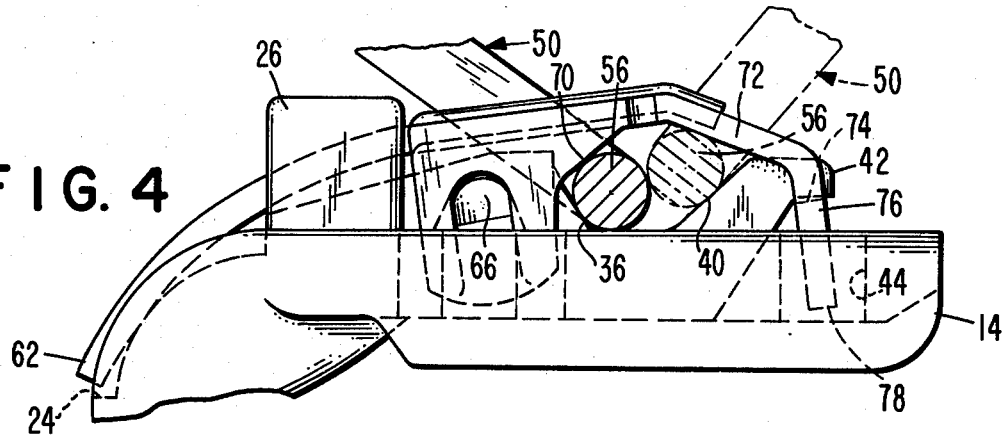
FIG. 4 is a side plan view similar to FIG. 3 of the slider of FIG. 1 in an unlocked position.

The operation of the slider 10 can now be understood by referring to FIGS. 3 and 4. When the slider 10 is installed in a slide fastener, the mounting tapes of the slide fastener are received between the opposed flanges 20 and 22 with the coupling elements of the slider fastener being received inside of the slider body 12 inside of the flanges 20 and 22 between the upper wings 14 and 16. When no force is being extended on the pull tab 50, as is shown in FIG. 3, the locking spring 60 urges the locking prong 78 through the locking hole 44 in the upper wing 14 of the slider body 12 and into the gap between the slide fastener coupling elements to prevent any movement of the slider 10. This automatic lock by the slider 10 on the slider fastener is released by pulling either way on the pull tab 50, as is shown in FIG. 4. This pulls the cross bar 56 of the pull tab 50 against one of the forward and rear cam surfaces 36 and 40 which cams the cross bar 56 upward so as to press against either the forward abutment surfaces 70 or the rear abutment surface 72 to flex the locking spring 60 to pull the locking prong 78 upward thus releasing the lock to allow the slider 10 to move along the slide fastener. As the locking spring 60 is flexed, the forward projection 62 is straightened but is retained in place by the spring groove 24 and the two guard lugs 26 on the slider body 12. The center of the locking spring 60 itself pivots about the retaining tabs 66 which are held within the retention cavities 32 in the slider body 12.

When the pull tab 50 is pulled in the forward direction to close the slide fastener, the cross arm 56 first contacts the forward cam surface 36 which cams it upward against the abutment surfaces 70 on the locking spring 60. So automatically as the pull tab 50 is pulled upward, the locking prong 78 is lifted and the lock is automatically released. Similarly of the pull tab 50 is pulled in the opposite direction to open the slide fastener, the cross arm 56 is cammed upward by the rear cam surface 40 so that it presses on the underside of the rear abutment surface 72 of the locking spring 60 to flex the spring and release the lock. Note that the hole 74 in the rear surface 72 of the locking spring 60 must be large enough to allow the locking prong 78 to be lifted clear of the slide fastener coupling elements before the finger 42 abuts the lower edge of the hole 74.

Figure 5:
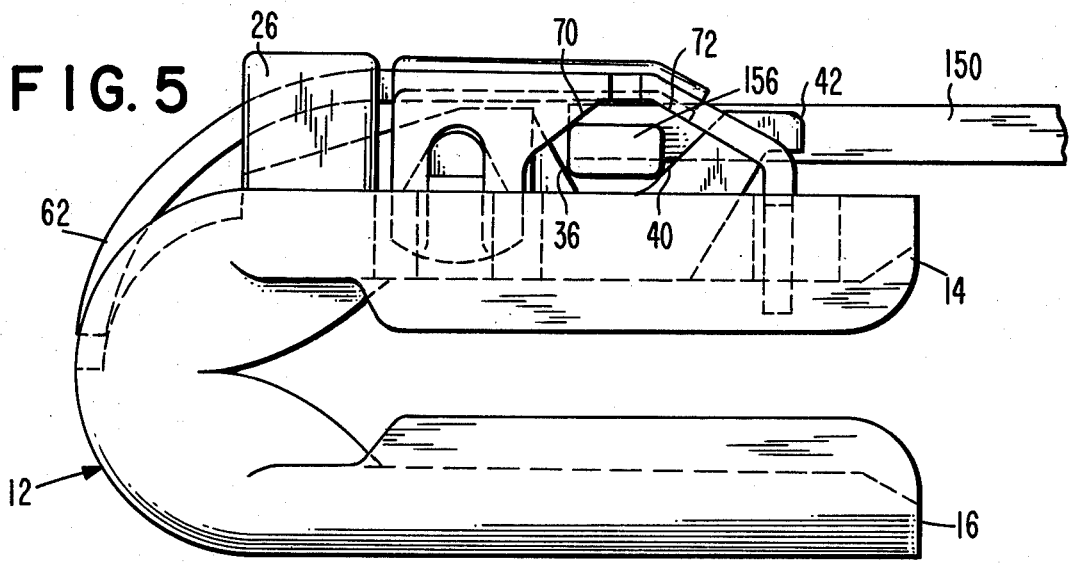
FIG. 5 is a side plan view similar to FIG 3 of an alternative embodiment of a slider constructed according to the present invention.

FIG. 5 shows an alternative embodiment of the present invention in which the slider is constructed using the slider body 12 and the locking spring 60 of the embodiment of FIGS. 1–4, but using a different pull tab 150. The pull tab 150 has at its forward end forwardly extending pull arms 154 which have a cross arm 156 formed extending between them. The cross arm 156 has a generally rectangular cross section with the corners of the rectangle being rounded. The cross bar 156 is also offset downwardly relative to the pull arms 154 so that the lower edge of the cross bar 156 is well below the lower edges of the pull arms 154.

The operation of the slider of FIG. 5 is similar to that of FIGS. 1–4 except that the pull tab 150 can now delatch the lock formed by the locking prong 78 in another fashion. By simply tilting the pull tab 150 upward, the long axis of the rectangle of the cross bar 156 can be tilted upward to lift the locking spring 60 without the need for engaging either of the cam surfaces 36 or 40. Of course the slider of FIG. 5 can also be de-latched by pulling the pull tab 150 in either direction to engage one of the cam surfaces 36 or 40 to lift the locking prong 78 similarly to the manner of operation of the slider of FIGS. 1–4. This embodiment allows the lock of the slider on the slider to also be unlocked by simply tilting upward of the pull tab 150 without any lateral pull being exerted on the pull tab 150, if this feature is desired in the particular application. To lock the slider of FIG. 5, the pull tab 150 has to be tilted into a position relatively close to horizontal as the slider is viewed in FIG. 5.

Inasmuch as the present invention is subject to many modifications, variations, and changes in detail, it is intended that all the material in the aforegoing specification or in the accompanying drawings be interpreted as illustrative, and not in a limiting sense.

What is claimed is:

1. A slider for a slide fastener comprising in combination, a slider body having upper and lower spaced parallel wings joined by a connecting post, said upper wing having formed on the top surface thereof a spring groove extending forward to the connecting post, a pair of upstanding lugs disposed on opposite sides of a longitudinal center line of the slider body and adjacent the spring groove formed on the top surface of the upper wing, a spring support disposed on the upper wing adjacent the pair of upstanding lugs and having a boss disposed on a vertical surface thereof, said boss having a cam surface defined by a steep ramp-like triangular extension, said spring support having retention means in opposite end surfaces thereof, cut-out slots disposed in the upper wing adjacent each of said retention cavities, a spring holding finger extending upward and rearward from the upper wing and defining a rear cam surface along a surface thereof, said rear cam surface being positioned to face said ramp-like triangular extension, said spring holding finger extending over a locking hole provided through the upper wing, a pull tab having a pair of extending pull arms formed along an end thereof and joined by a cross bar extending therebetween, said cross bar being disposed for co-operating movement between said rear cam surface of the spring holding finger and the said ramp-like triangular extension of the spring support, a locking spring having a plate-like body with an elongated and downwardly curved projection extending to the spring groove from its front end and having a pair of downwardly extending retention arms formed midway along its sides, said retention arms being positioned each in a cut-out slot and having retaining tabs bent inwardly and disposed for engagement within said retention means of the spring support, sloped abutment surfaces provided on the bottom of the locking spring connected to back edges of each of the retention arms and to the main portion of the locking spring by canted surfaces, a downwardly canted abutment surface of the locking spring having a cut-out portion positioned for receiving said holding finger, and a tail portion extending vertically downward from the canted abutment surface of the locking spring and terminating in the locking hole as a locking prong, said locking prong disposed to prevent movement of the slider along the slide fastener when in normal position whereby any pulling of the pull tab lifts the locking prong to free the slider for movement.

2. A slider as claimed in claim 1 wherein the retention means on the slider body is formed as a pair of arch-shaped cavities defined in opposite sides of the boss.

3. A slider as claimed in claim 1 wherein the pair of guide lugs are formed on the upper wing of the slider body just adjacent the spring groove to restrain movement of the forward projection.

4. A slider as claimed in claim 1 wherein the cross bar has a circular cross-section with the diameter of the cross-section being equal to the width of the pull arms.

5. A slider as claimed in claim 1 wherein the cross bar has a generally rectangular cross section with the corners of the rectangle being rounded.

6. A slider as claimed in claim 5 wherein the cross arm is offset downward relative to the pull arms so that the cross bar extends below the pull arms.

* * * * *